US008708470B1

(12) United States Patent
Blowfield et al.

(10) Patent No.: US 8,708,470 B1
(45) Date of Patent: Apr. 29, 2014

(54) INK SYSTEM

(71) Applicant: Videojet Technologies Inc., Wood Dale, IL (US)

(72) Inventors: Philip Blowfield, Northants (GB); Salhadin Omer, Cambridge (GB); Paul King, Whittlesey (GB)

(73) Assignee: Videojet Technologies Inc., Wood Dale, IL (US)

( * ) Notice: Subject to any disclaimer, the term of this patent is extended or adjusted under 35 U.S.C. 154(b) by 0 days.

(21) Appl. No.: 13/751,622

(22) Filed: Jan. 28, 2013

Related U.S. Application Data

(60) Provisional application No. 61/731,183, filed on Nov. 29, 2012.

(51) Int. Cl.
*B41J 2/175* (2006.01)

(52) U.S. Cl.
USPC ..... 347/86

(58) Field of Classification Search
USPC ..... 347/7, 19, 84–87, 89–90
See application file for complete search history.

(56) References Cited

U.S. PATENT DOCUMENTS

| | | | | | |
|---|---|---|---|---|---|
| 4,360,817 | A * | 11/1982 | Arway et al. | ..... | 347/90 |
| 5,860,363 | A * | 1/1999 | Childers et al. | ..... | 101/483 |
| 6,017,118 | A * | 1/2000 | Gasvoda et al. | ..... | 347/86 |
| 6,170,937 | B1 * | 1/2001 | Childers et al. | ..... | 347/85 |
| 8,366,252 | B2 * | 2/2013 | Zaba et al. | ..... | 347/86 |

* cited by examiner

*Primary Examiner* — Anh T. N. Vo
(74) *Attorney, Agent, or Firm* — Joseph A. Yosick

(57) ABSTRACT

A fluid container for an ink jet printer includes a collapsible reservoir, a cap, and an electronic storage device. The collapsible reservoir is for containing a printing fluid and includes walls enclosing an internal space having a variable volume for storage and dispensing of a liquid. The cap for attachment to the reservoir includes a port for connection to the printer. The port is adapted to prevent air from entering the internal space from outside the reservoir as liquid is dispensed. An electronic storage device is configured to store data relating to the contents of the container. At least one electrical contact is associated with the electronic storage device and provided on a substrate.

15 Claims, 6 Drawing Sheets

INK SYSTEM

CROSS REFERENCE TO RELATED APPLICATIONS

This application claims priority to U.S. Provisional Application No. 61/731,183 filed Nov. 29, 2012, and incorporated herein by reference in its entirety

BACKGROUND

The present disclosure relates to containers for dispensing liquids, particularly refill containers for dispensing inks or solvents for use in printers, such as ink jet printers, particularly continuous ink jet printers.

In ink jet printing systems the print is made up individual droplets of ink generated at a nozzle and propelled towards a substrate. There are two principal systems: drop on demand where ink droplets for printing are generated as and when required; and continuous ink jet printing in which droplets are continuously produced and only selected ones are directed towards the substrate, the others being recirculated to an ink supply.

Continuous ink jet printers supply pressurized ink to a print head drop generator where a continuous stream of ink emanating from a nozzle is broken up into individual regular drops by an oscillating piezoelectric element. The drops are directed past a charge electrode where they are selectively and separately given a predetermined charge before passing through a transverse electric field provided across a pair of deflection plates. Each charged drop is deflected by the field by an amount that is dependent on its charge magnitude before impinging on the substrate whereas the uncharged drops proceed without deflection and are collected at a gutter from where they are recirculated to the ink supply for reuse. The charged drops bypass the gutter and hit the substrate at a position determined by the charge on the drop and the position of the substrate relative to the print head.

Typically the substrate is moved relative to the print head in one direction and the drops are deflected in a direction generally perpendicular thereto, although the deflection plates may be oriented at an inclination to the perpendicular to compensate for the speed of the substrate (the movement of the substrate relative to the print head between drops arriving means that a line of drops would otherwise not quite extend perpendicularly to the direction of movement of the substrate).

In continuous ink jet printing a character is printed from a matrix comprising a regular array of potential drop positions. Each matrix comprises a plurality of columns (strokes), each being defined by a line comprising a plurality of potential drop positions (e.g. seven) determined by the charge applied to the drops. Thus each usable drop is charged according to its intended position in the stroke. If a particular drop is not to be used then the drop is not charged and it is captured at the gutter for recirculation. This cycle repeats for all strokes in a matrix and then starts again for the next character matrix.

Ink is delivered, under pressure, to the print head by an ink supply system that is generally housed within a sealed compartment of a cabinet that includes a separate compartment for control circuitry and a user interface panel. The system includes a main pump that draws the ink from a reservoir or tank via a filter and delivers it under pressure to the print head. As ink is consumed the reservoir is refilled as necessary from a replaceable ink container that is releasably connected to the reservoir by a supply conduit, with the replacement ink suitably being supplied through an ink top-up pump which is connected to an outlet port of the replaceable ink container by means of the supply conduit. The ink is fed from the reservoir, suitably via a flexible delivery conduit to the print head by the main pump. The unused ink drops captured by the gutter are recirculated to the reservoir via a return conduit by a pump. The flow of ink in each of the conduits is generally controlled by solenoid valves and/or other like components.

As the ink circulates through the system, there is a tendency for it to thicken as a result of solvent evaporation, particularly in relation to the recirculated ink that has been exposed to air in its passage between the nozzle and the gutter. In order to compensate for this "make-up" solvent is added to the ink as required from a replaceable solvent container so as to maintain the ink viscosity within desired limits. This solvent may also be used for flushing components of the print head, such as the nozzle and the gutter, in a cleaning cycle. A solvent top-up pump may be used for supplying the solvent from the replaceable solvent container via a supply conduit.

Hence a typical continuous ink jet printer has both a replaceable ink container and a replaceable solvent container. Suitably, each container has a port through which the respective liquid, ink or solvent, is dispensed. The port for each container is connected, via fluid-tight means, to a pumping system adapted to dispense liquid from the container to the reservoir. In this description, both replaceable ink containers and replaceable solvent containers are referred to as containers or cartridges.

BRIEF SUMMARY

The present disclosure provides a bulk fluid container for use with a continuous inkjet system. The container provides a much larger amount of fluid than conventional fluid containers or cartridges, thus enabling the printer to be run a much longer period of time without having to replace fluids.

In one aspect, a fluid container for an ink jet printer includes a collapsible reservoir, a cap, and an electronic storage device. The collapsible reservoir is for containing a printing fluid and includes walls enclosing an internal space having a variable volume for storage and dispensing of a liquid. The cap for attachment to the reservoir, includes a port for connection to the printer. The port is adapted to prevent air from entering the internal space from outside the reservoir as liquid is dispensed. An electronic storage device is configured to store data relating to the contents of the cartridge. At least one electrical contact is associated with the electronic storage device and provided on a substrate.

In another aspect, an ink jet printer includes a print head for generating ink drops for printing on to a printable substrate; an ink supply system for supplying ink to the print head; a fluid container; and a fluid container receiving portion arranged to receive the fluid container and to provide fluid communication between the container outlet and the ink supply system, the fluid container receiving portion having at least one electrical contact arranged for electrical contact with the at least one electrical contact on the container when the container is received.

The foregoing paragraphs have been provided by way of general introduction, and are not intended to limit the scope of the following claims. The presently preferred embodiments, together with further advantages, will be best understood by reference to the following detailed description taken in conjunction with the accompanying drawings.

DETAILED DESCRIPTION

Figure 1:
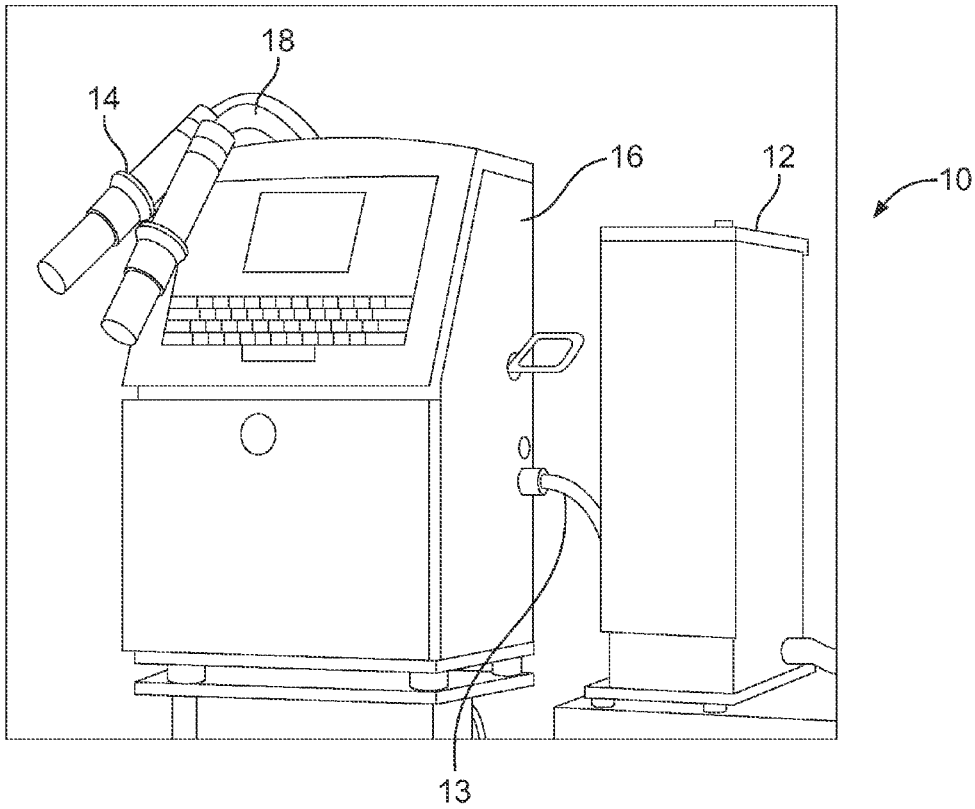
FIG. 1 shows an embodiment of a continuous ink jet printer.

The invention is described with reference to the drawings in which like elements are referred to by like numerals. The relationship and functioning of the various elements of this invention are better understood by the following detailed description. However, the embodiments of this invention as described below are by way of example only, and the invention is not limited to the embodiments illustrated in the drawings.

The present disclosure provides a bulk fluid container for use with a continuous inkjet system. The container provides a much larger amount of fluid (around 5 liters) than conventional fluid containers or cartridges, thus enabling the printer to be run a much longer period of time without having to replace fluids. The container includes a chip which contains data such as fluid type, expiration date, and volume which allows the printer to make sure the correct fluid is used, and to enable tracking of the fluid volume remaining in the container. The system is particularly useful for systems using ink based on organic solvents such as ketones and alcohols, such as acetone, methyl ethyl ketone, and ethanol.

Referring now to the ink jet printer 10 shown in FIG. 1 of the drawings, ink is delivered from an ink supply system 12 via tube 13 to a cabinet 16 and thence to a print head or print heads 14 and back via flexible tubes which are bundled together with other fluid tubes and electrical wires (not shown) into what is referred to in the art as an "umbilical" conduit 18. In operation, the ink or solvent is drawn from a reservoir of ink in the ink supply system 12 by a system pump. Further details of an embodiment of the printer system are disclosed in US 20100208013A1 and US 20100220129A1, assigned to Videojet Technologies Inc., the contents of which are incorporated by reference. However, it can be seen that the ink supply system 12 disclosed herein can be used with other print systems and other types of printers.

Figure 2:
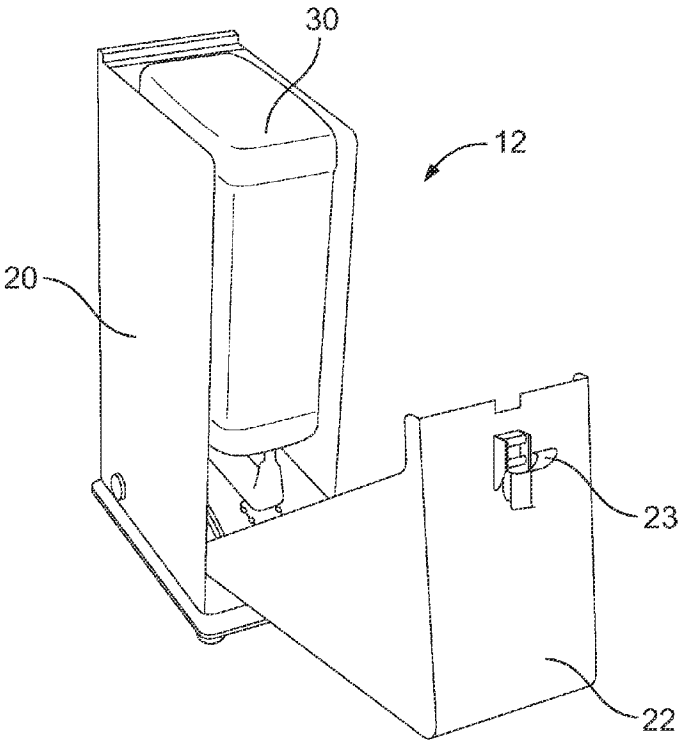
FIG. 2 shows an embodiment of a housing for a container.

FIG. 2 shows an embodiment of a housing 12 for a container. The housing 12 includes a base 20 and a cover 22. Disposed within the housing is a container 30 for holding and supplying fluid to the printer. The fluid may be ink or solvent (make-up). The cover may include a latch 23 for securing the cover 22 to the base 20 and a hinge 25 for allowing hinged movement of the cover with respect to the base. The components of the housing 12 may be made of any suitable material, such as steel, particularly stainless steel.

Figure 3:
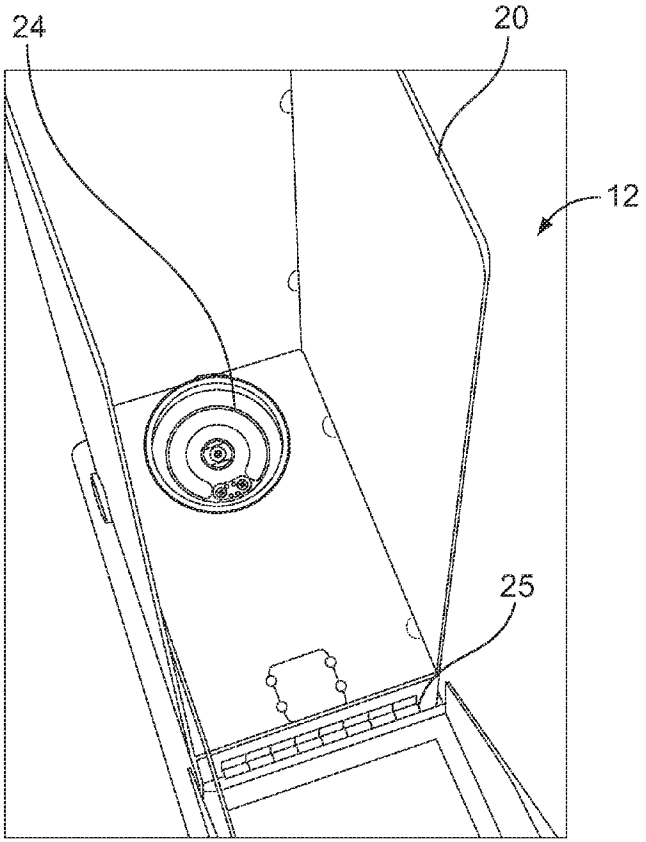
FIG. 3 shows an embodiment of an empty housing.

FIG. 3 shows an embodiment of an empty housing 12. Visible within the housing is receiving portion 24. The container 30 is adapted to be inserted within the housing with the cap side down, with the crown of the container 30 engaging the receiving portion 24 to provide fluid to the printer 10.

Figure 5:
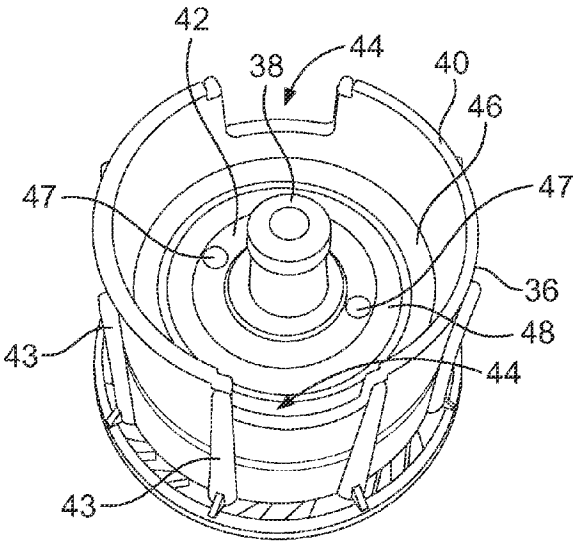
FIG. 5 shows an embodiment of a cap member.
Figure 4:
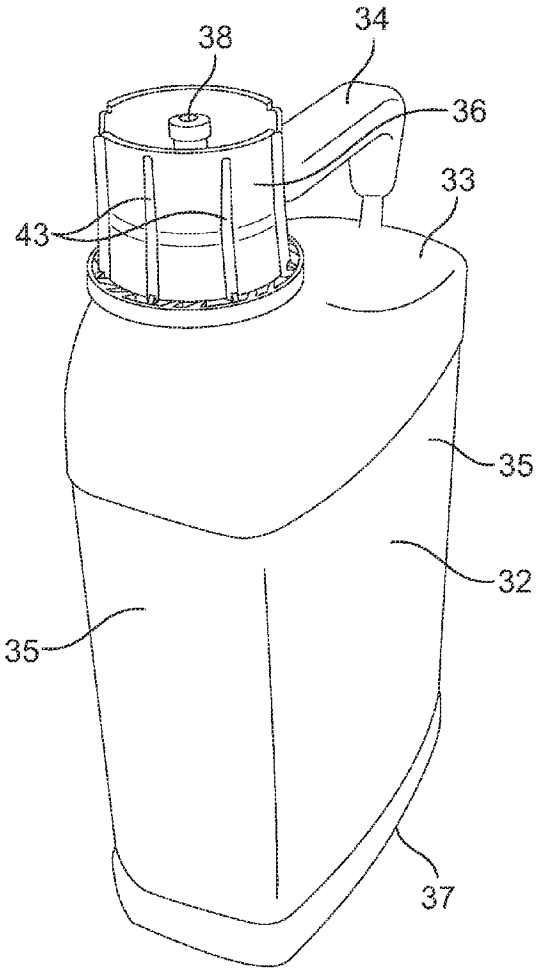
FIG. 4 shows an embodiment of a fluid container.

FIG. 4 shows an embodiment of a fluid container 30. The fluid container 30 includes reservoir 32, handle 34, cap member 36, and port 38. FIG. 5 shows an embodiment of cap member 36. Cap member 36 includes port 38 disposed at a center portion, generally circular wall 40 disposed at the periphery, and substrate 42 disposed around the port 38 and within the wall 40. Port 38 is adapted to provide fluid communication with reservoir 32 to allow fluid to be dispensed from the container 30. Wall 40 may include notches 44 around its crown. Wall 40 serves to protect the port 38 during handling so that it is not damaged, thus causing fluid to leak from the container 30. Ribs 43 extend from the bottom to the crown of cap member 36 to provide structural support. The cap member may be made from any suitable material, such as a suitable plastic.

The reservoir 32 is collapsible and includes walls enclosing an internal space having a variable volume for storage and dispensing of a liquid. The container 30 may include top wall 33, at least one side wall 35, and bottom wall 37. The container 30 may be general rectilinear in shape with parallel side walls and parallel top and bottom walls. The cap member 36 is attached to the reservoir 32 and includes a port 38 for connection to the housing 12. The port 32 is adapted to prevent air from entering the internal space from outside the reservoir 32 as liquid is dispensed. An electronic storage device (not shown) is configured to store data relating to the contents of the cartridge. For example, the electronic storage device may include information on the ink or fluid type, expiration date, amount of fluid remaining in the reservoir 32, and the like. Electrical contacts 46, 48 are associated with the electronic storage device and provided on a substrate 42. The electrical contacts 46, 48 may be circular or annular in shape, but other configurations are of course possible. The substrate 42 may be secured to the cap member 36 by any suitable mechanism, such as knobbed posts 47. A pump (not shown) provides a vacuum to withdraw fluid through the port 38. The reservoir 32 is essentially air-tight and the walls of the reservoir 32 collapse as the fluid is withdrawn.

In one embodiment, the reservoir 32 is adapted to support a reduction in pressure of the internal space whereby the equilibrium pressure difference between the internal space and the surrounding atmosphere increases substantially monotonically in magnitude as liquid is dispensed, and wherein the port is adapted to allow liquid to be dispensed when a withdrawal pressure at the exterior of the port is less than the equilibrium pressure of the internal space.

Figure 7:
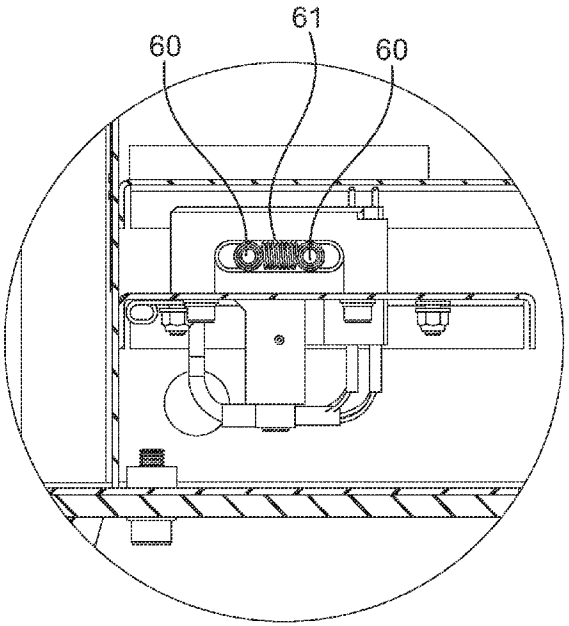
FIG. 7 is an enlarged view of area 7 of FIG. 6 showing a side view of an embodiment of a receiving portion of a housing.
Figure 6:
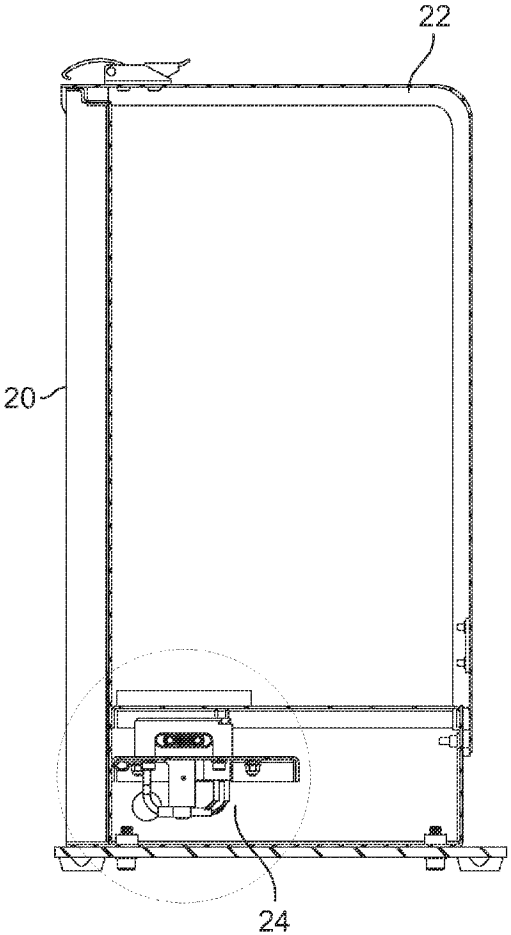
FIG. 6 is a cross-sectional side view of an embodiment of a receiving portion of a housing.
Figure 8:
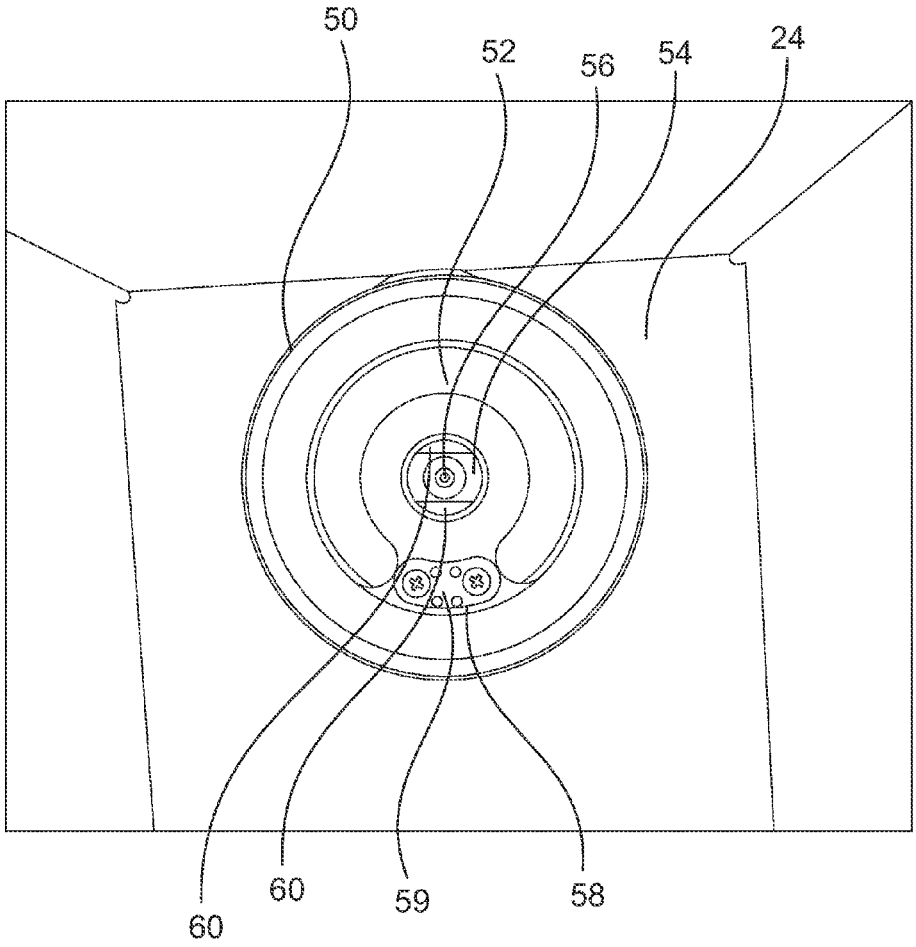
FIG. 8 shows an embodiment of a receiving portion of a housing.

FIGS. 6-8 show an embodiment of a receiving portion 24 of the housing 12. Receiving portion 24 includes an outer peripheral wall 50, cap support 52, aperture 54, needle 56 disposed in aperture 54, and electrical contact member 58. When the container 30 is positioned within housing 12, receiving portion 24 is configured to engage the features of cap member 36. In particular, port 38 is disposed in aperture 54 and needle 56 is configured to pierce a septum of port 38 to enable fluid to be withdrawn from container 32. Contact members 58 engage electrical contacts 46, 48. In particular, contact member 58 may include spring-loaded pins 59 that push against the electrical contacts 46, 48 to provide an electrical connection between the ink jet printer and the electronic storage device disposed on substrate 42. Wall 36 engages cap support 52. Bars or securing members 60 act to engage the extending portion of port 38 to secure it within the receiving portion 24. It can be seen in FIG. 7 that securing members 60 are attached to spring 61. When the container 30 is inserted into receiving portion 24, port 38 moves securing members 60 laterally. After the port 38 is fully seated, the spring 61 urges members 60 back into channel or groove 63 of port 38 to secure the container 30 within the housing 12.

Figure 10:
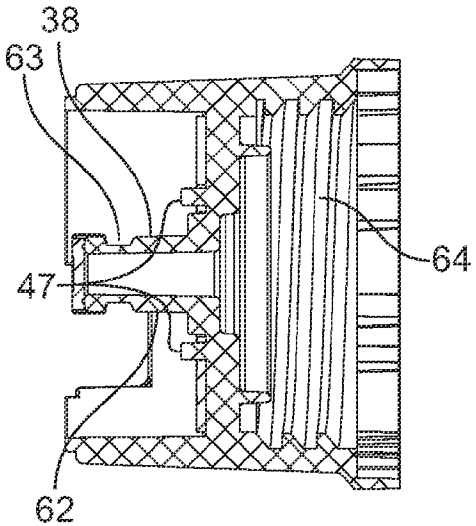
FIG. 10 shows a side view of the cap member of FIG. 9 along line 10-10.
Figure 9:
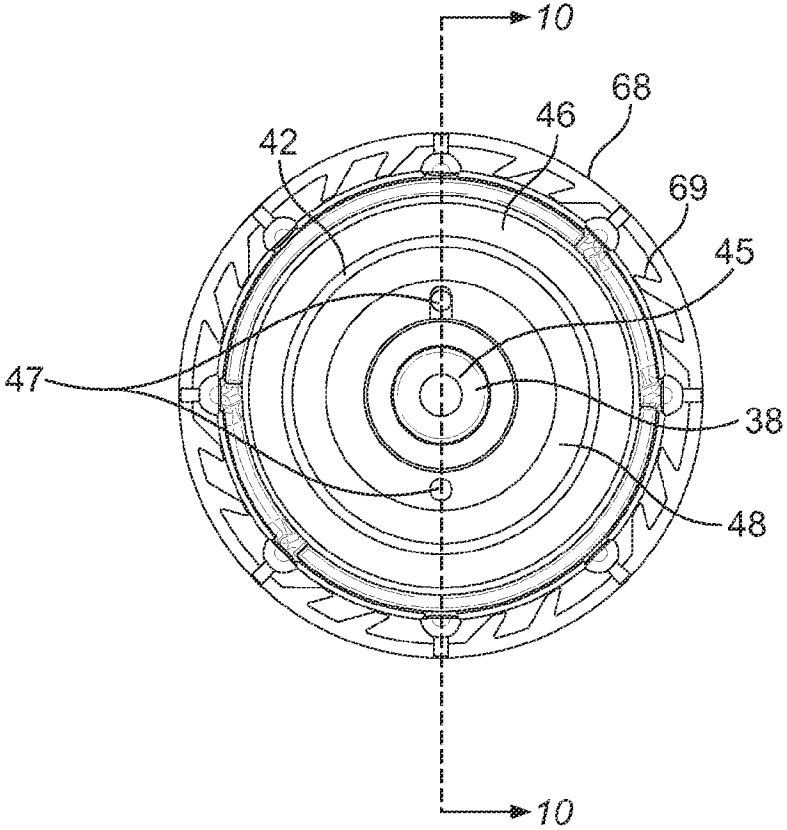
FIG. 9 shows a top view of an embodiment of a cap member.

FIG. 9 shows a top view of an embodiment of a cap member 36. FIG. 10 shows a side view of the cap member 36 of FIG. 9 along line 10-10. The substrate 42 may be generally circular in shape and include an aperture 45. The port 38 has a neck 62 that is disposed through aperture 46 and thus surrounded by the substrate 42. The cap member 36 has a locking element 68 for locking engagement with the reservoir 32 for locking the cap 36 to the reservoir 32 when the cap 36 is threaded onto the reservoir 32. The locking mechanism 68 may include internally directed ridges or ramps 69. Ramps 69 engage corresponding ridges or indentations (not shown) around the periphery of a top portion of reservoir 32. This system functions as a tamper indicator by allowing the cap member 36 to be inserted or threaded onto the reservoir 32 to secure it thereto, but making it difficult to remove the cap member 36 from the reservoir 32 without damaging the cap member 36. In one embodiment, the cap includes threads 64 for attachment to a corresponding thread on the reservoir 32.

In one embodiment, the reservoir of the container includes a rigid framework and one or more elastically deformable sections. As liquid is removed from the reservoir through the port, the walls become convex towards the internal space leading to an equilibrium pressure difference between the internal space and the outside of the reservoir (the outside of the reservoir will be at atmospheric pressure, which remains relatively constant). If the atmospheric pressure is P, and the pressure in the internal space is PI, where PI<P then the pressure required to withdraw liquid through the valved port will be Pw, where PW<PI. This pressure difference (pressure reduction) will increase substantially monotonically in magnitude as more liquid is removed from the reservoir. By increasing substantially monotonically, it is meant that a decrease in the volume of liquid generally leads to an increased magnitude of pressure difference, although minor deviations from this behavior (say of a decrease of no more than 10% in pressure difference before decrease is continued, preferably no more than 5%, more preferably no more than 1%) may be tolerated provided that the overall trend is an increase in magnitude of pressure difference as volume of liquid decreases.

By rigid it is meant that the framework does not deform substantially, when the pressure difference between the inner space of the reservoir and the outside is up to 50 kPa, preferably up to 70 kPa.

Preferably, the rigid framework of the reservoir is formed by edges joining the walls of the reservoir, and at least one wall is elastically deformable, such that tension can develop in the at least one deformable wall as the volume of the internal space is decreased as liquid is dispensed from it. Suitably, all of the walls of the reservoir are elastically deformable. The angle between the walls where they join at their edges confers rigidity upon these edges.

Preferably, the walls form a generally box-shaped reservoir comprising two opposed face walls of similar shape joined at their perimeters by edge walls having their width substantially normal to the opposed parallel faces. Suitably, the edge walls have a width which is less than 30% of the smallest width of the opposed face walls, preferably less than 20%. This allows the opposed face walls to deform smoothly towards each other as the internal space reduces as liquid is dispensed. The opposed face walls are suitably substantially mutually parallel.

Suitably, the walls are of an elastic polymer such as high density polyethylene. Any suitable elastic material may be used for the walls. The reservoir may be formed from a thermoplastic material, suitably by blow moulding. The cap may be injection molded.

The described and illustrated embodiments are to be considered as illustrative and not restrictive in character, it being understood that only the preferred embodiments have been shown and described and that all changes and modifications that come within the scope of the inventions as defined in the claims are desired to be protected. It should be understood that while the use of words such as "preferable", "preferably", "preferred" or "more preferred" in the description suggest that a feature so described may be desirable, it may nevertheless not be necessary and embodiments lacking such a feature may be contemplated as within the scope of the invention as defined in the appended claims. In relation to the claims, it is intended that when words such as "a," "an," "at least one," or "at least one portion" are used to preface a feature there is no intention to limit the claim to only one such feature unless specifically stated to the contrary in the claim. When the language "at least a portion" and/or "a portion" is used the item can include a portion and/or the entire item unless specifically stated to the contrary.

What is claimed is:

1. A fluid container for an ink jet printer, the container comprising:

a collapsible reservoir for containing a printing fluid, the reservoir comprising walls enclosing an internal space having a variable volume for storage and dispensing of the fluid;

a cap for attachment to the reservoir, the cap including a port for fluid connection to the printer, wherein the port has a neck and is adapted to prevent air from entering the internal space from outside the reservoir as liquid is dispensed;

an electronic storage device disposed on the cap and configured to store data relating to the contents of the container; and at least one electrical contact associated with the electronic storage device and provided on a substrate, wherein the contact is circular in shape and wherein the substrate defines an aperture that is disposed adjacent to and surrounds the neck of the port.

2. The fluid container of claim 1, wherein the reservoir is adapted to support a reduction in pressure of the internal space whereby the equilibrium pressure difference between the internal space and the surrounding atmosphere increases substantially monotonically in magnitude as liquid is dispensed, and wherein the port is adapted to allow liquid to be dispensed when a withdrawal pressure at the exterior of the port is less than the equilibrium pressure of the internal space.

3. The fluid container of claim 1, wherein the cap has a rigid supporting surface adjacent to the substrate.

4. The fluid container of claim 1 wherein the substrate is circular in shape.

5. The fluid container of claim 1 wherein the substrate encircles the port.

6. The fluid container of claim 1 wherein the cap is threaded for attachment to a corresponding thread on the reservoir.

7. The fluid container of claim 6 wherein the cap comprises a locking mechanism for locking the cap to the reservoir when the cap is threaded onto the reservoir.

8. The fluid container of claim 7 wherein the reservoir comprises ridges or indentations for engaging the locking mechanism of the cap.

9. An ink jet printer comprising:

a print head for generating ink drops for printing on to a printable substrate;

an ink supply system for supply ink to the print head;

a fluid container according to claim 1; and a fluid container receiving portion arranged to receive the fluid container and to provide fluid communication between the container outlet and the ink supply system, the fluid container receiving portion having at least one electrical contact arranged for electrical contact with the at least one electrical contact on the container when the container is received.

10. The ink jet printer of claim 9, wherein the receiving portion comprises a pair of members for engaging the port, the pair of members biased to urge them against a portion of the port.

11. The ink jet printer of claim 10, wherein the port comprises a groove for engaging the pair of members.

12. The ink jet printer of claim 9, wherein the printer is of the continuous type in which there is provided a catcher at the print head for receiving unused drops of ink generated and an ink return path for returning ink to the ink supply system.

13. The fluid container of claim 1 wherein the reservoir comprises a rigid framework and one or more elastically deformable sections.

14. The fluid container of claim 13 wherein the rigid framework is formed by edges joining the walls and at least one wall is elastically deformable.

15. The fluid container of claim 1 wherein the walls form a box-shaped reservoir comprising two opposed face walls of similar shape joined at their perimeters by edge walls having their width substantially normal to the opposed parallel faces.

* * * * *